US005651726A

United States Patent [19]

Skogsberg

[11] Patent Number: 5,651,726

[45] Date of Patent: Jul. 29, 1997

[54] MOUNTING APPARATUS FOR GRINDING WHEELS

[75] Inventor: Lars Torbjörn Skogsberg, Stenhamra, Sweden

[73] Assignee: Atlas Copco Tools AB, Nacka, Sweden

[21] Appl. No.: 553,595

[22] PCT Filed: May 19, 1994

[86] PCT No.: PCT/SE94/00475

§ 371 Date: Nov. 17, 1995

§ 102(e) Date: Nov. 17, 1995

[87] PCT Pub. No.: WO94/26462

PCT Pub. Date: Nov. 24, 1994

[30] Foreign Application Priority Data

May 19, 1993 [SE] Sweden ..... 9301716

[51] Int. Cl.[6] ..... B24B 45/00

[52] U.S. Cl. ..... 451/342; 451/178; 82/160; 408/239 R; 409/232

[58] Field of Search ..... 82/160; 279/2.12, 279/2.15; 403/277, 292, 297; 408/238, 239 R, 239 A; 409/232, 233; 451/178, 342

[56] References Cited

U.S. PATENT DOCUMENTS

| | | | |
|---|---|---|---|
| 820,474 | 5/1906 | Buchanan . | |
| 1,761,859 | 1/1928 | Wilson et al. . | |
| 3,912,411 | 10/1975 | Moffat | 451/342 X |
| 4,655,006 | 4/1987 | Block | 451/342 |
| 5,031,361 | 7/1991 | MacKay, Jr. | 451/342 |
| 5,287,659 | 2/1994 | Timmons et al. | 451/342 |

FOREIGN PATENT DOCUMENTS

| | | | |
|---|---|---|---|
| 1286928 | 8/1972 | United Kingdom . | |
| 88/06507 | 9/1988 | WIPO | 451/342 |

*Primary Examiner*—Timothy V. Eley
*Attorney, Agent, or Firm*—Frishauf, Holtz, Goodman, Langer & Chick

[57] ABSTRACT

A mounting apparatus for securing alternative grinding wheels to a threaded portion of an output shaft of a portable rotary grinding machine, the mounting apparatus comprising a threaded clamping device which cooperates with the threaded portion of the output shaft; a support hub which rigidly mounts on the output shaft, the support hub having an inner annular contact surface and an outer annular contact surface for backing grinding wheels mounted on the output shaft. The inner and outer annular contact surfaces are disposed concentrically relative to each other as well as relative to the output shaft, and the inner and outer annular contact surfaces are disposed at different axial levels such that the outer annular contact surface protrudes in front of the inner annular contact surface. Two alternatively applicable flanged clamping elements are provided, each having a respective annular plane contact surface and each clamping element being alternatively arranged to cooperate with the threaded clamping device. One of the clamping elements has a contact surface which opposes and is substantially equal in size to the outer annular contact surface of the hub, and the other of the clamping elements has a contact surface which opposes and is substantially equal in size to the inner annular contact surface of the hub.

23 Claims, 2 Drawing Sheets

MOUNTING APPARATUS FOR GRINDING WHEELS

BACKGROUND OF THE INVENTION

This invention relates to a mounting apparatus for securing alternative grinding wheels to the output shaft of a portable rotary grinding machine, in which a threaded clamping device is used for cooperation with a threaded portion of the output shaft.

This new type of mounting means is intended to meet the securing requirements set up both for so called depressed centre grinding wheels and for plane cutting wheels.

SUMMARY OF THE INVENTION

The mounting apparatus according to the present invention comprises a hub and two alternative clamping elements and is intended to accomplish both an outer annular clamping zone for cutting wheels and an inner annular clamping zone for depressed centre wheels.

According to the securing requirements, each type of grinding wheel shall be clamped between a set of annular clamping surfaces which rise above surrounding portions of the hub and the clamping elements, respectively, (for example by at least 0.5 mm). The difference between the two sets of clamping surfaces is that the clamping surfaces intended for the cutting wheel have to be larger in diameter than the clamping surfaces for the depressed centre wheel.

DETAILED DESCRIPTION

Figure 5:
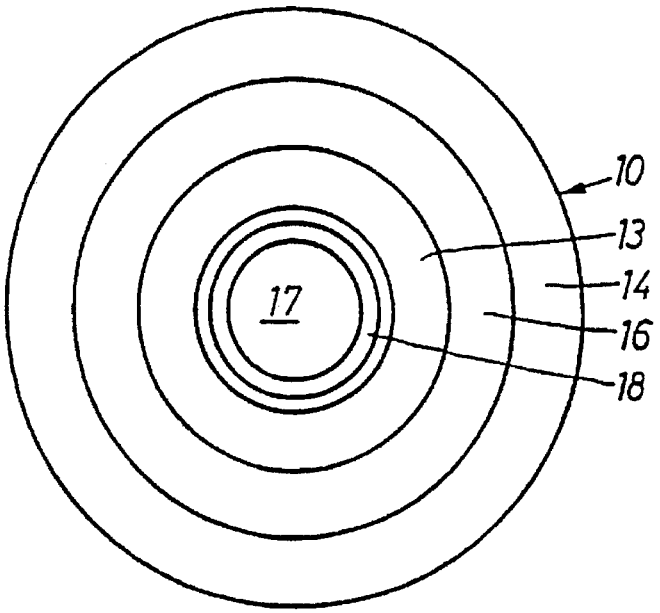
FIG. 5 shows an end view of the support hub shown in FIG. 3.
Figure 3:
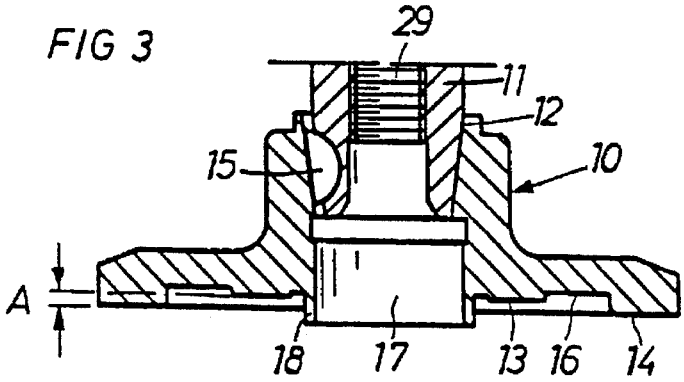
FIG. 3 shows a longitudinal section through the front part of the output shaft and the support hub.

The new mounting means shown in the drawing figures comprises a support hub 10 rigidly mounted on the output shaft 11 of a rotary grinding machine. The support hub 10 is coupled to the shaft 11 by a tapered socket portion 12 and a woodruff key 15. As being apparent from FIGS. 3 and FIG. 5, the support hub 10 is formed with an inner annular contact surface 13 and an outer annular contact surface 14. The outer and inner contact surfaces 13, 14 are spaced from each other by an annular groove 16 which is at least 0.5 mm deep from any of the contact surfaces 13, 14. In the illustrated embodiment of the invention, the outer contact surface 14 protrudes in front of the inner contact surface 13 by a distance of about 0.5 mm.

As an axial continuation of the tapered socket portion 12, the hub 10 is formed with a cylindrical socket 17 which is open at the front end of the hub. The opening end of the socket 17 is surrounded by a tubular extension 18 which protrudes axially in front of both the inner and outer contact surfaces 13, 14 so as to form a centering portion for the grinding wheels.

Figure 4A:
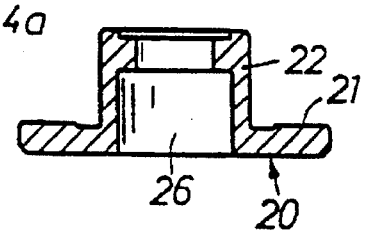
FIG. 4*a* shows a longitudinal section through the clamping element intended for depressed centre wheels.

In FIG. 4*a* there is shown a flanged clamping element 20 which is formed with an annular contact surface 21 of a size equal to the inner contact surface 13 of the hub 10. The clamping element 20 also comprises an axially extending neck portion 22 which is intended to fit snugly in the socket 17 of the hub 10.

Figure 4B:
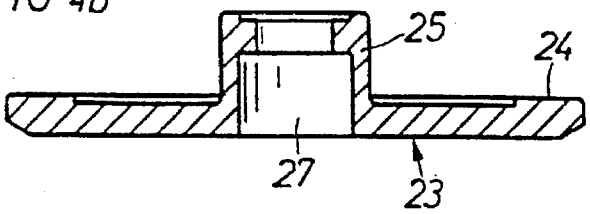
FIG. 4*b* shows a longitudinal section through a clamping element intended for cutting wheels.

In FIG. 4*b* there is shown another clamping element 23 which is formed with a radial flange on which there is annular contact surface 24 of a size equal to the outer contact surface 14 of the hub 10. This clamping element 23 also comprises an axially extending neck portion 25 which is intended to fit snugly in the socket 17 of the hub 10.

As being illustrated in FIGS. 4*a* and 4*b*, both of the clamping elements 20, 23 are provided with a stepped bore 26 and 27, respectively, through which a clamping screw 28 extends to engage a threaded bore 29 in the output shaft 11 of the grinding machine.

Figure 2:
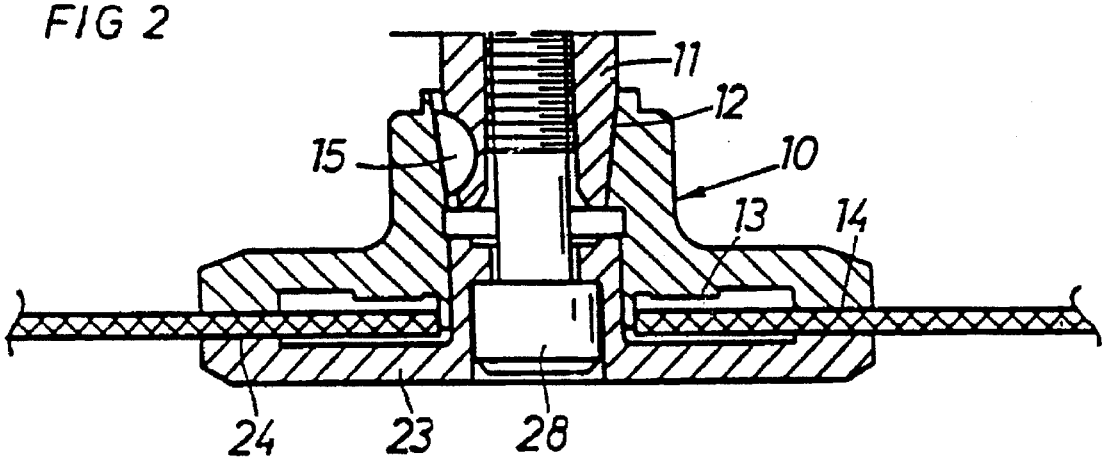
FIG. 2 shows a similar section as in FIG. 1 but illustrates a plane cutting wheel being secured.

In this embodiment of the invention there is illustrated a difference in axial levels between the inner contact surface 13 and the outer contact surface 14 of the support hub, a difference which is designated by the letter A. This difference is about 0.5 mm and ensures that the inner contact surface 13 normally does not reach the plane cutting wheel as the latter is mounted as illustrated in FIG. 2. This is to prevent small particles like grindings from being jammed between the cutting wheel and the surface 13 and, thereby, cause bending forces on the latter. Instead, the cooperation between the outer contact surface 14 of the hub 10 and the contact surface 24 of the clamping element 23 ensures a large diameter clamping zone by which the cutting wheel is firmly supported.

Figure 1:
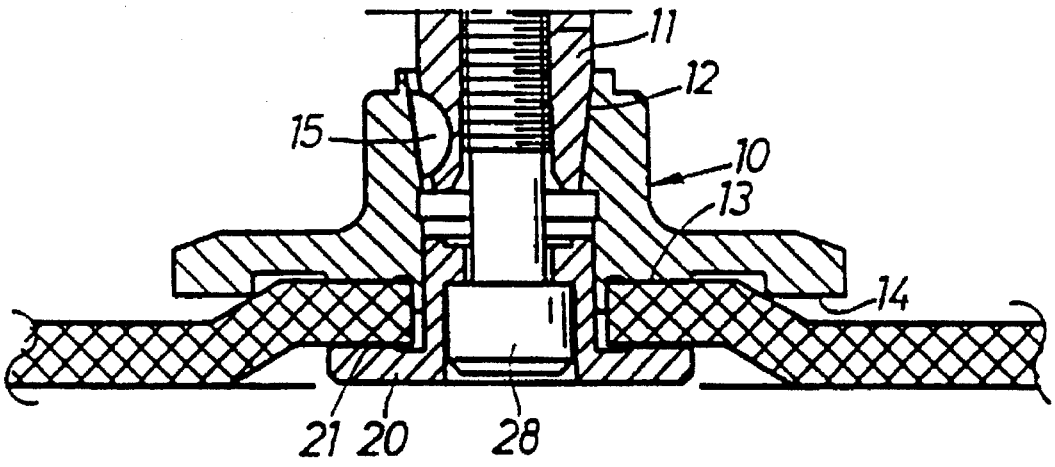
FIG. 1 shows a longitudinal section through the mounting device according to the invention when securing a depressed centre wheel.

When using the new mounting means for securing a depressed centre wheel as illustrated in FIG. 1, the inner contact surface 13 of the support hub 10 cooperates with the contact surface 21 of the smaller clamping element 20 to obtain an annular clamping zone having the same dimensions as the inner contact surface 13.

In both applications, the clamping force exerted on the grinding wheels is accomplished by the central clamping screw 28.

It is to be noted that the invention is not limited to the above described embodiment, especially concerning the means for securing the support hub onto the output spindle of the rotary grinding machine, but may be adapted to the actual type of grinding machine.

I claim:

1. A mounting apparatus for securing alternative grinding wheels to an output shaft of a portable rotary grinding machine, the output shaft having a threaded portion, the mounting apparatus comprising:

a threaded clamping device which cooperates with the threaded portion of said output shaft;

a support hub which rigidly mounts on said output shaft;

said support hub having an inner annular contact surface and an outer annular contact surface for backing grinding wheels mounted on said output shaft, both of said inner and outer annular contact surfaces being plane and facing in the axial direction of said output shaft;

said inner and outer annular contact surfaces being disposed concentrically relative to each other as well as relative to said output shaft, and said inner and outer annular contact surfaces being disposed at different axial levels such that said outer annular contact surface protrudes in front of said inner annular contact surface; and two alternatively applicable flanged clamping elements, each of said clamping elements having a respective annular plane contact surface and each of said clamping elements being alternatively arranged to cooperate with said threaded clamping device;

one of said clamping elements having a contact surface which opposes said outer annular contact surface of said hub and is substantially equal in size to said outer annular contact surface of said hub, and the other of said clamping elements having a contact surface which opposes said inner annular contact surface of said hub and is substantially equal in size to said inner annular contact surface of said hub.

2. The mounting apparatus according to claim 1, wherein said inner and outer annular contact surfaces of said hub are separated from each other by an annular groove.

3. The mounting apparatus according to claim 2, wherein said hub has a central socket portion, and each of said clamping elements has an axially extending neck portion which in the mounted condition of the respective clamping element extends into said socket portion of said hub.

4. The mounting apparatus according to claim 2, wherein said hub has a central tubular extension for centering a mounted grinding wheel, and wherein said tubular extension extends axially beyond both of said inner and outer annular contact surfaces.

5. The mounting apparatus according to claim 1, wherein said outer annular contact surface protrudes in front of said inner annular contact surface by less than 1 mm.

6. The mounting apparatus according to claim 5, wherein said outer annular contact surface protrudes in front of said inner annular contact surface by at least 0.5 mm.

7. The mounting apparatus according to claim 6, wherein said hub has a central socket portion, and each of said clamping elements has an axially extending neck portion which in the mounted condition of the respective clamping element extends into said socket portion of said hub.

8. The mounting apparatus according to claim 6, wherein said hub has a central tubular extension for centering a mounted grinding wheel, and wherein said tubular extension extends axially beyond both of said inner and outer annular contact surface.

9. The mounting apparatus according to claim 5, wherein said hub has a central socket portion, and each of said clamping elements has an axially extending neck portion which in the mounted condition of the respective clamping element extends into said socket portion of said hub.

10. The mounting apparatus according to claim 5, wherein said hub has a central tubular extension for centering a mounted grinding wheel, and wherein said tubular extension extends axially beyond both of said inner and outer annular contact surfaces.

11. The mounting apparatus according to claim 1, wherein said hub has a central socket portion, and each of said clamping elements has an axially extending neck portion which in the mounted condition of the respective clamping element extends into said socket portion of said hub.

12. The mounting apparatus according to claim 1, wherein said hub has a central tubular extension for centering a mounted grinding wheel, and wherein said tubular extension extends axially beyond both of said inner and outer annular contact surfaces.

13. The mounting apparatus according to claim 1, wherein said threaded clamping device comprises a threaded screw which threadably engages said threaded portion of said output shaft.

14. The mounting apparatus according to claim 1, wherein said contact surface of said one of said clamping elements is at substantially the same radial distance from the center axis of said output shaft as said outer annular contact surface of said hub.

15. The mounting apparatus according to claim 14, wherein said contact surface of said one of said clamping elements has the same area as said outer annular contact surface of said hub.

16. The mounting apparatus according to claim 15, wherein said contact surface of said other of said clamping elements has the same area as said inner annular contact surface of said hub.

17. The mounting apparatus according to claim 14, wherein said contact surface of said other of said clamping elements is at substantially the same radial distance from the center axis of said output shaft as said inner annular contact surface of said hub.

18. The mounting apparatus according to claim 17, wherein said contact surface of said other of said clamping elements has the same area as said inner annular contact surface of said hub.

19. The mounting apparatus according to claim 1, wherein said contact surface of said one of said clamping elements has the same area as said outer annular contact surface of said hub.

20. The mounting apparatus according to claim 19, wherein said contact surface of said other of said clamping elements has the same area as said inner annular contact surface of said hub.

21. The mounting apparatus according to claim 1, wherein said contact surface of said other of said clamping elements is at substantially the same radial distance from the center axis of said output shaft as said inner annular contact surface of said hub.

22. The mounting apparatus according to claim 21, wherein said contact surface of said other of said clamping elements has the same area as said inner annular contact surface of said hub.

23. The mounting apparatus according to claim 1, wherein said contact surface of said other of said clamping elements has the same area as said inner annular contact surface of said hub.

* * * * *